US007032407B2

(12) United States Patent
Chastine

(10) Patent No.: US 7,032,407 B2
(45) Date of Patent: Apr. 25, 2006

(54) METHODS AND APPARATUS FOR REFRIGERATOR COMPARTMENT

(75) Inventor: Gary Lester Chastine, Louisville, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/608,047

(22) Filed: Jun. 27, 2003

(65) Prior Publication Data

US 2004/0261444 A1 Dec. 30, 2004

(51) Int. Cl.
*F25D 17/08* (2006.01)

(52) U.S. Cl. ..... 62/408; 62/441

(58) Field of Classification Search ..... 62/441, 62/440, 89, 407, 404, 408, 187, 457.1–457.9
See application file for complete search history.

(56) References Cited

U.S. PATENT DOCUMENTS 3,232,071 A * 2/1966 Wallenbrock et al. ..... 62/207
3,759,053 A * 9/1973 Swaneck, Jr. ..... 62/157
4,689,966 A * 9/1987 Nonaka ..... 62/187
5,758,512 A 6/1998 Peterson et al.
5,839,287 A 11/1998 Stormo
6,055,826 A * 5/2000 Hiraoka et al. ..... 62/408
6,327,867 B1 * 12/2001 Hyodo et al. ..... 62/187
6,405,548 B1 * 6/2002 Hollenbeck ..... 62/186
6,447,083 B1 * 9/2002 Chiapetta et al. ..... 312/404
6,497,113 B1 * 12/2002 Yamada et al. ..... 62/441

FOREIGN PATENT DOCUMENTS

JP 10 332243 3/1999
JP 10 339542 3/1999
JP 1 127879 6/2001

OTHER PUBLICATIONS

International Search Report (10 pgs.); International Application of General Electric Company; PCT App. No.: PCT/US2004/015705; filing date Nov. 3, 2005.

* cited by examiner

*Primary Examiner*—William E. Tapolcai
(74) *Attorney, Agent, or Firm*—H. Neil Houser, Esq.; Armstrong Teasdale LLP

(57) ABSTRACT

A refrigerator is provided. The refrigerator includes a refrigeration compartment, a freezer compartment, and a third compartment controllable in both a refrigeration mode and a freezer mode.

23 Claims, 7 Drawing Sheets

METHODS AND APPARATUS FOR REFRIGERATOR COMPARTMENT

BACKGROUND OF THE INVENTION

This invention relates generally to refrigerators, and more particularly, to control systems for refrigerator compartments.

Some known refrigerators include a fresh food compartment and a freezer compartment. Such a refrigerator also typically includes a refrigeration sealed system circuit including a compressor, an evaporator, and a condenser connected in series. An evaporator fan is provided to blow air over the evaporator, and a condenser fan is provided to blow air over the condenser. In operation, when an upper temperature limit is reached in the freezer compartment, the compressor, evaporator fan, and condenser fan are energized. Once the temperature in the freezer compartment reaches a lower temperature limit, the compressor, evaporator fan, and condenser fan are de-energized.

Known household refrigerators include side-by-side, top mount, and bottom mount type refrigerators. Typical control systems maintain the cooling environments of the refrigerator volume and the freezer volume. However, in each refrigerator configuration, the refrigeration volume and the freezer volume are fixed. It would be desirable to vary or increase the amount of refrigerator volume or freezer volume regardless of refrigerator configuration.

BRIEF DESCRIPTION OF THE INVENTION

In one aspect, a refrigerator is provided. The refrigerator includes a refrigeration compartment, a freezer compartment, and a third compartment controllable in both a refrigeration mode and a freezer mode.

In another aspect, a freezer compartment is provided. The freezer compartment includes an upper compartment including an evaporator and a fan therein, the evaporator and the fan enclosed by an evaporator cover having an inlet and an outlet, a lower compartment separated from the upper compartment by a dividing wall, a duct extending through the dividing wall, the duct provides flow communication between the upper and lower compartments, the duct has a damper disposed therein for opening and closing the duct, the duct has a duct fan disposed therein. The freezer compartment further includes a supply conduit having a first end. The first end is coupled to the evaporator cover, and the second end is coupled to the duct such that the supply conduit provides flow communication from the evaporator to the duct.

In a further aspect, a freezer compartment is provided. The freezer compartment includes an upper compartment including an evaporator and a fan therein, the evaporator and fan enclosed by an evaporator cover having an inlet and an outlet, a lower compartment separated from the upper compartment by a dividing wall, the dividing wall having a top surface and a bottom surface, a first duct extending through the dividing wall providing an opening from the top surface to the bottom surface, the first duct is proximate to the evaporator inlet, a second duct extending through the dividing wall providing an opening from the top surface to the bottom surface. The freezer compartment further includes a gate damper coupled to the top surface of the dividing wall, the gate damper is rotatable between an open position and a closed position.

DETAILED DESCRIPTION OF THE INVENTION

Figure 1:
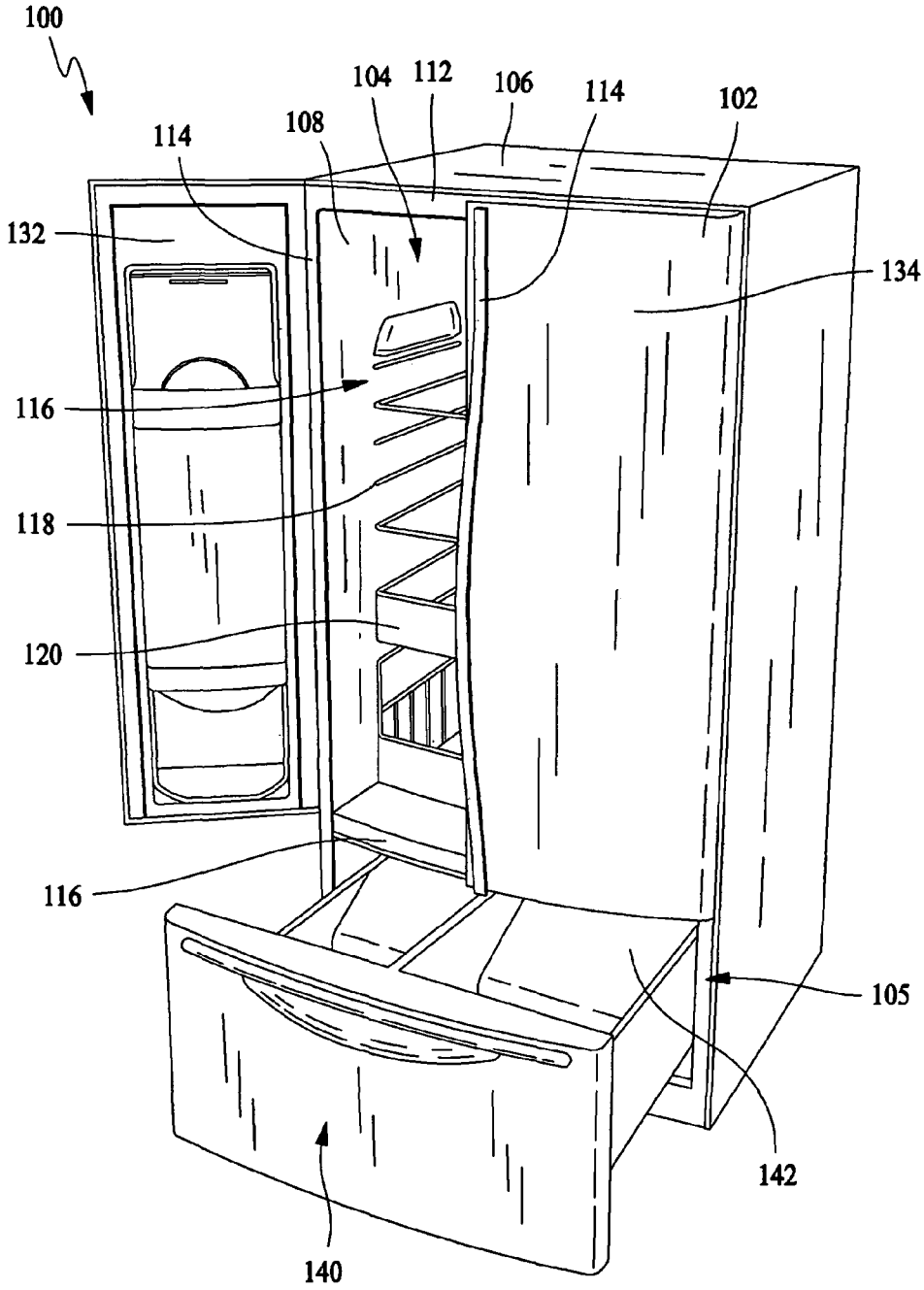
FIG. 1 is a perspective view of a refrigerator.

FIG. 1 illustrates a refrigerator 100 having a first compartment 102, a second compartment 104, and a third compartment 105. In the exemplary embodiment, first compartment 102 is a refrigeration or fresh food storage compartment 102, second compartment is a freezer compartment 104, and third compartment can be configured to be either a fresh food compartment or freezer compartment. Thus, third compartment 105 is controllable to operate in either a refrigeration mode or freezer mode. Fresh food compartment 102 and freezer compartment 104 are arranged side-by-side.

It is contemplated, however, that the teaching of the description set forth below is applicable to other types of refrigeration appliances, including but not limited to top and bottom mount refrigerators. The present invention is therefore not intended to be limited to any particular type or configuration of a refrigerator, such as refrigerator 100.

Fresh food storage compartment 102, freezer storage compartment 104 and third compartment 105 are contained within an outer case 106 and inner liner 108. A space between case 106 and liner 108 is filled with foamed-in-place insulation. Outer case 106 normally is formed by folding a sheet of a suitable material, such as pre-painted steel, into an inverted U-shape to form top and side walls of case. A bottom wall of case 106 normally is formed separately and attached to the case side walls and to a bottom frame that provides support for refrigerator 100. Inner liner 108 is molded from a suitable plastic material to form fresh food compartment 102, freezer compartment 104, and third compartment 105, respectively. Alternatively, liner 108 may be formed by bending and welding a sheet of a suitable metal, such as steel.

A breaker strip 112 extends between a case front flange and outer front edges of liners. Breaker strip 112 is formed from a suitable resilient material, such as an extruded acrylo-butadiene-styrene based material (commonly referred to as ABS).

Mullion 114 is insulation and is preferably formed of an extruded ABS material. Breaker strip 112 and mullion 114 form a mullion wall 116 that extends completely around inner peripheral edges of case 106, vertically between fresh food compartment 102 and freezer compartment 104, and horizontally to separate fresh food compartment 102 and freezer compartment 104 from third compartment 105.

Shelves 118 and slide-out drawers 120 normally are provided in freezer compartment 104 to support items being stored therein. In addition, an ice maker (not shown in FIG. 1) may be provided in freezer compartment 104.

A freezer door 132 and a fresh food door 134 close access openings to fresh food and freezer compartments 102, 104, respectively. Each door 132, 134 is mounted by a top hinge (not shown) and a bottom hinge (not shown) to rotate about its outer vertical edge between an open position and a closed position closing the associated storage compartment.

In one embodiment, third compartment 105 has a drawer 140 slidably received within third compartment 105. The drawer 140 provides access to third compartment 105. In another embodiment, drawer has at least one slide-out basket 142, which is operated independently from the drawer. In a further embodiment, third compartment 105 has a door (not shown) coupled to third compartment 105 and the door is rotatable about at least one of a horizontal and vertical access.

In accordance with known refrigerators, refrigerator 100 also includes a machinery compartment (not shown) that at least partially contains components for executing a known vapor compression cycle for cooling air. The components include a compressor (not shown in FIG. 1), a condenser (not shown in FIG. 1), an expansion device (not shown in FIG. 1), and an evaporator (not shown in FIG. 1) connected in series and charged with a refrigerant. The evaporator is a type of heat exchanger which transfers heat from air passing over the evaporator to a refrigerant flowing through the evaporator, thereby causing the refrigerant to vaporize. The cooled air is used to refrigerate one or more refrigerator or freezer compartments via fans (not shown in FIG. 1). Collectively, the vapor compression cycle components in a refrigeration circuit, associated fans, and associated compartments are referred to herein as a sealed system. The construction of the sealed system is well known and therefore not described in detail herein, and the sealed system is operable to force cold air through the refrigerator subject to the following control scheme.

Figure 3:
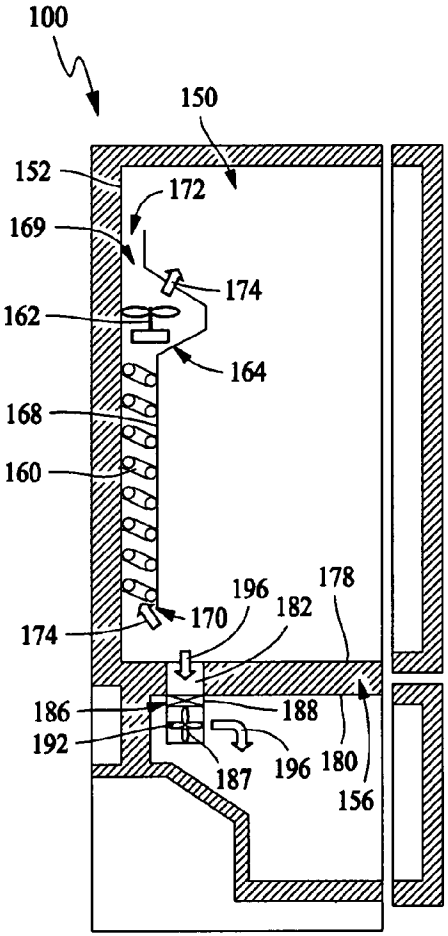
FIG. 3 is a side view of an embodiment of the refrigerator having upper and lower components.
Figure 2:
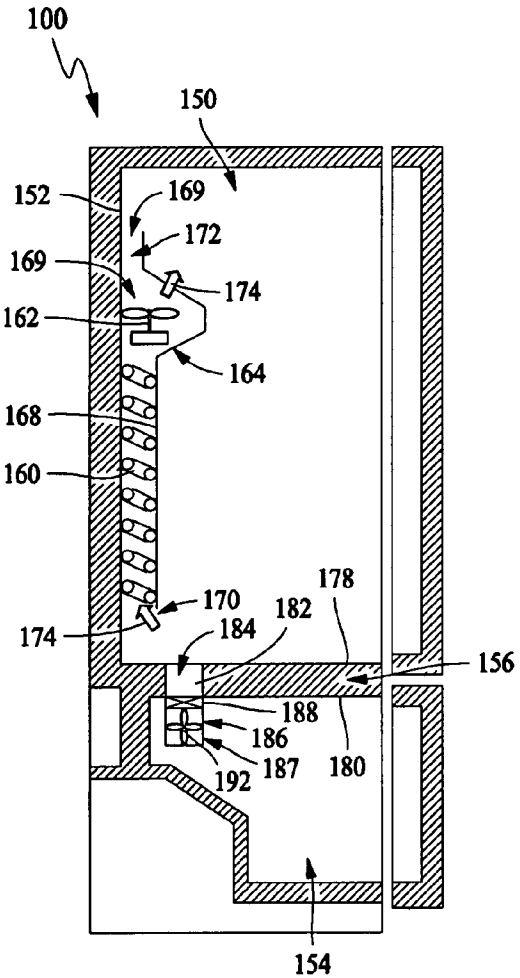
FIG. 2 is a side view of an embodiment of the refrigerator having upper and lower components.

FIGS. 2 and 3 are side views of an embodiment of refrigerator 100. Refrigerator 100 has an upper compartment 150, such as freezer compartment 104 and a lower compartment 154, such as third compartment 105. Upper compartment 150 has at least a rear wall 152. Upper compartment 150 is separated from lower compartment 154 by a dividing wall 156. Upper compartment 150 has an evaporator 160 disposed along rear wall 152 of upper compartment 150. A fan and motor assembly 162 are disposed in an upper region 164 of evaporator 160. Evaporator 160 and fan and motor assembly 162 are enclosed by an evaporator cover 168. Evaporator cover 168 forms a channel 169 with rear wall 152 providing an inlet 170 and an outlet 172 for evaporator 160. Fan and motor assembly 162 causes the air within upper compartment 150 to circulate into evaporator 160 from inlet 170, through evaporator 160, and be discharged through outlet 172, or through evaporator cover 168 as indicated by arrows 174.

Dividing wall 156 has a top surface 178 and a bottom surface 180. Dividing wall 156 has a duct 182 therethrough providing an opening 184 from top surface 178 to bottom surface 180 allowing flow communication between upper compartment 150 and lower compartment 154. An assembly portion 186 extends from duct 182 into lower compartment 154. Assembly portion 186 has a damper 188 and a duct fan 192 disposed therein. In one embodiment, damper 188 and duct fan 192 are disposed substantially within duct 182. As shown in FIG. 2, damper 188 is closed. In FIG. 3, damper 188 is open and duct fan 192 is energized causing air to flow from upper compartment 150, through duct 182, through assembly portion 186, and through an outlet 187 of assembly portion 186 into lower compartment 154, as indicated by arrows 196. In a refrigerator mode, air is supplied to lower compartment 154 until lower compartment 154 is cooled to fresh food compartment conditions. In a freezer mode, air is supplied to lower compartment 154 until lower compartment 154 is cooled to freezer food compartment conditions. Thus, lower compartment 154 is convertible between a fresh food storage compartment and a freezer storage compartment. In one embodiment, damper 188 and duct fan 192 are manually operated by a user. In another embodiment, damper 188 and duct fan 192 are controlled by a controller (not shown), such as a micro-processor, according to user preference via manipulation of a control interface.

Figure 4:
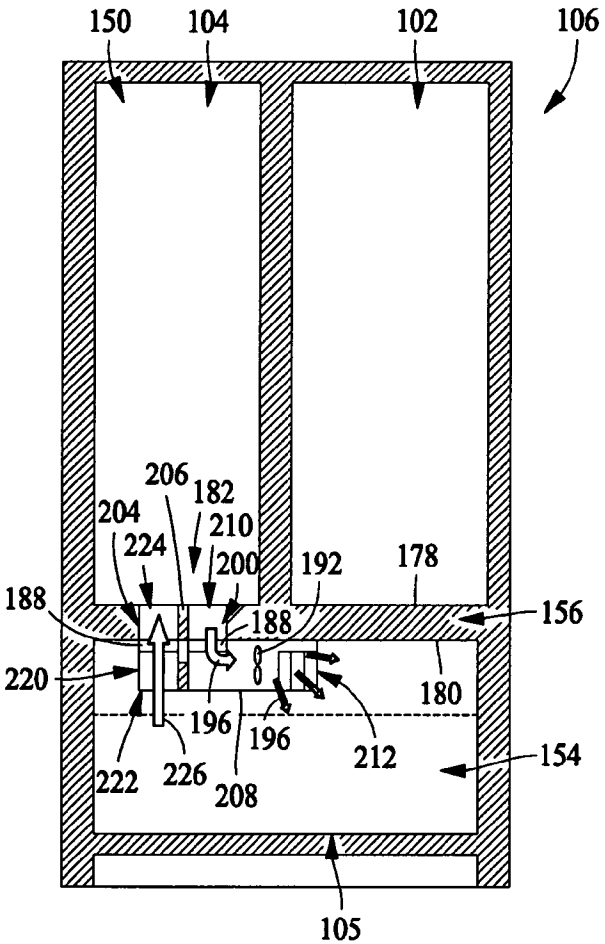
FIG. 4 is a front view of the refrigerator shown in FIGS. 2 and 3.

FIG. 4 is a front view of refrigerator 100 shown in FIGS. 2 and 3. Duct 182 is bifurcated into a first duct 200 and a second duct 204. First and second ducts 200 and 204 are divided by a duct wall 206. First duct 200 has a first assembly portion 208 extending into lower compartment 154 and along bottom surface 180 of dividing wall 156. First duct 200 has a first duct inlet 210 and a first duct outlet 212. First assembly portion 208 has duct fan 192 disposed therein. When duct fan 192 is energized, duct fan 192 causes air to flow from upper compartment 150 to lower compartment 154 through first duct 200 as indicated by arrows 196. Second duct 204 has a second assembly portion 220 extending into lower compartment 154. Second duct 204 has a second duct inlet 222 and a second duct outlet 224. Second duct 204 allows air to return from lower compartment 154 to upper compartment 150 as indicated by arrow 226. First and second ducts 200 and 204 each have damper 188 disposed therein for controlling, opening and closing of first duct inlet 210 and second duct outlet 224. In another embodiment, a single damper is utilized for controlling the opening and closing of first and second ducts.

Figure 5:
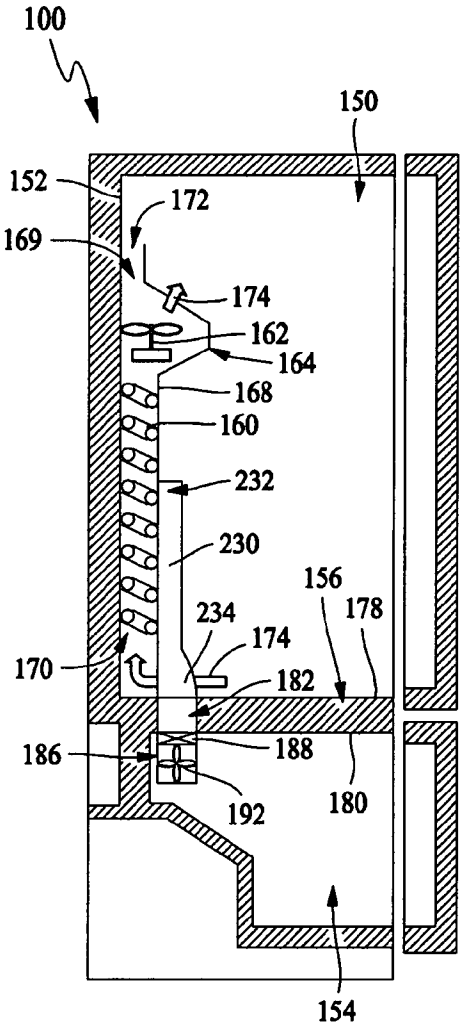
FIG. 5 is a side view of another embodiment of the refrigerator having upper and lower components.
Figure 7:
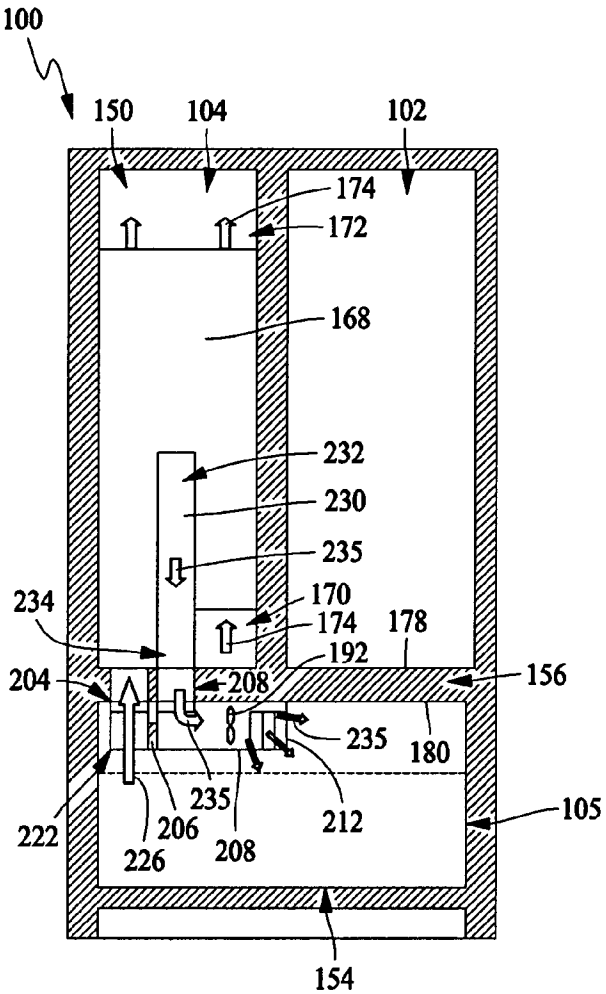
FIG. 7 is a front view of the refrigerator shown in FIGS. 5 and 6.
Figure 6:
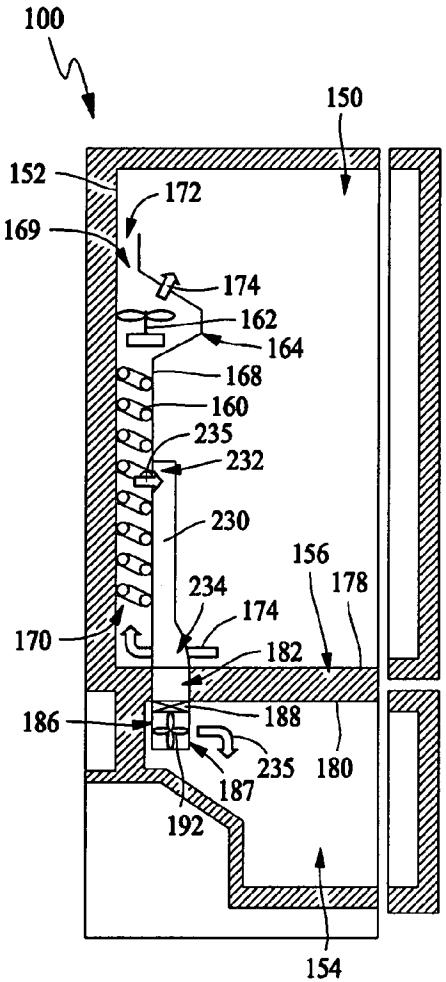
FIG. 6 is a side view of another embodiment of the refrigerator having upper and lower components.

FIGS. 5 and 6 are side views of another embodiment of refrigerator 100 having upper and lower components 150 and 154. A supply conduit 230 is provided in upper compartment 150. Supply conduit 230 has one end 232 coupled to evaporator cover 168 between inlet 170 and outlet 172 of evaporator 160, and another end 234 coupled to duct 182. In FIG. 5, damper 188 is closed and duct fan 192 is off. When duct fan 192 is on and damper 188 is open, as shown in FIG. 6, partially evaporated air is extracted from evaporator 160 and drawn into lower compartment 154 as indicated by arrows 235. FIG. 7 is a front view of refrigerator shown in FIGS. 5 and 6. In another embodiment, one end 232 of supply conduit 230 may be coupled to evaporator cover 168 anywhere in between inlet 170 and outlet 172 of evaporator 160 to vary the amount of evaporated air supplied to lower compartment 154. For example, if supply conduit 230 is coupled closer to evaporator outlet 172 evaporator, the air supplied to lower compartment 154 would be more evaporated than if supply conduit 230 was coupled closer to evaporator inlet 170.

Figure 9:
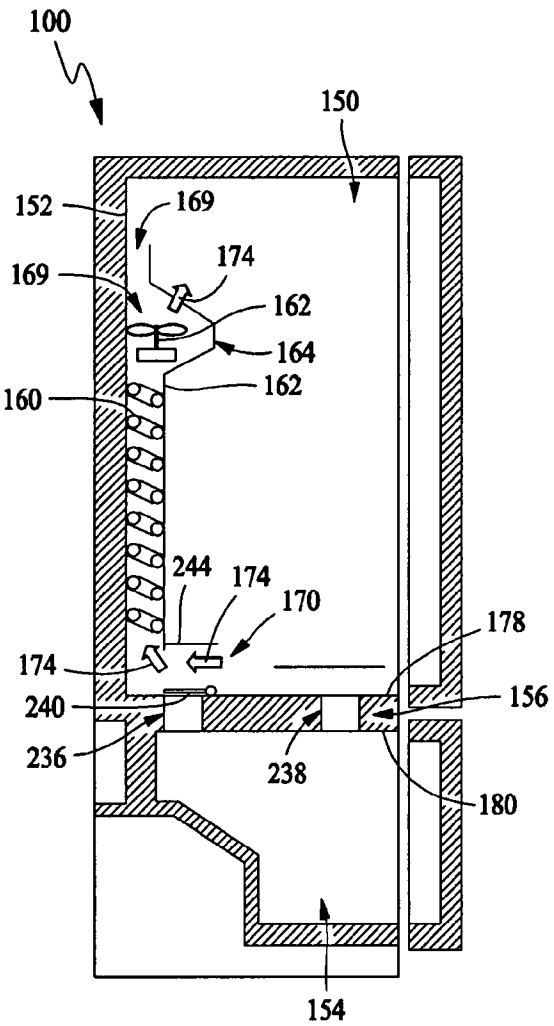
FIG. 9 is a side view of another embodiment of the refrigerator having upper and lower components.
Figure 8:
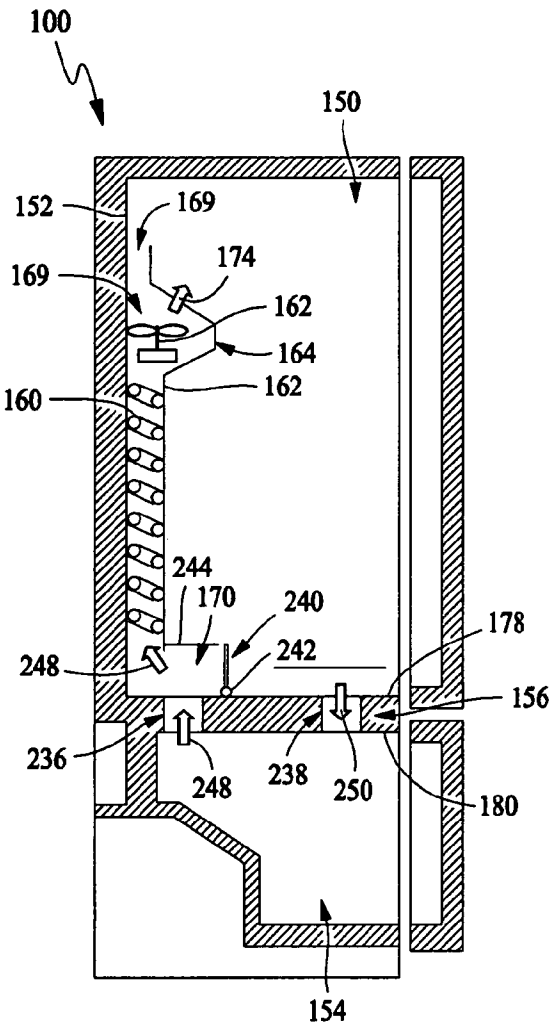
FIG. 8 is a side view of another embodiment of the refrigerator having upper and lower components.

FIGS. 8 and 9 are side views of another embodiment of refrigerator 100 with upper and lower compartments 150 and 152. Dividing wall 156 has a first duct 236 and a second duct 238, whereby first duct 236 is proximate to evaporator inlet 170. A gate damper 240 has one end 242 coupled to top surface 178 of dividing wall 156. In one embodiment, gate damper 240 is hingedly connected to top surface 178 of dividing wall 156. Evaporator cover 168 has an evaporator inlet cover 244. In one embodiment, evaporator inlet cover 244 extends substantially parallel to top surface 178 of dividing wall 156. Gate damper 240 is rotatable between an open position and a closed position. In the open position, as shown in FIG. 8, gate damper 240 is substantially perpendicular to top surface 178 of dividing wall 170, such that gate damper 240 and evaporator inlet cover 244 effectively seal off evaporator inlet 170 from the air within upper compartment 150. In the open position, air is allowed to flow from lower compartment 154 through first duct 236 and directly into evaporator inlet 170, as indicated by arrows 248. In addition, air flows from upper compartment 150 to lower compartment 154 through second duct 238 as indicated by arrow 250. In the closed position, as shown in FIG. 9, gate damper 240 is substantially parallel to top surface 178 of dividing wall 156, such that gate damper 240 substantially covers first duct 236. When first duct 236 is covered, lower compartment 154 is substantially sealed off from upper compartment 150 allowing air within upper compartment 150 to enter into evaporator 160 through evaporator inlet 170, as indicated by arrows 174. In one embodiment, a second gate damper (not shown in FIGS. 8 and 9) is hingedly connected to top surface 178 of dividing wall 156. The second gate damper is rotatable between an open and a closed position for opening and closing first duct 236.

Figure 10:
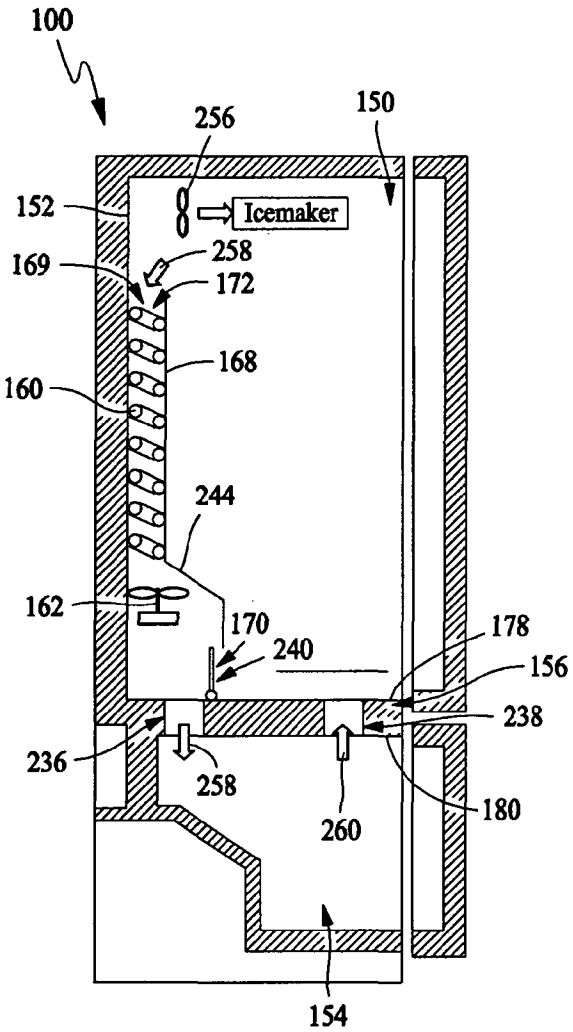
FIG. 10 is a side view of another embodiment of the refrigerator having upper and lower components.

FIG. 10 is a side view of another embodiment of refrigerator 100 with upper and lower compartments 150 and 152. At least one of fan and motor assembly 162 and a secondary fan 256, such as an ice making fan, are operated such that the air flow through evaporator 160 is reversed. When gate damper 240 is in the open position, air is circulated from evaporator outlet 172, through evaporator 160, through evaporator inlet 170, through first duct 236, and into lower compartment 154, as indicated by arrows 258. Air is returned from lower compartment 154 to upper compartment 150 through second duct 238, as indicates by arrow 260.

Figure 11:
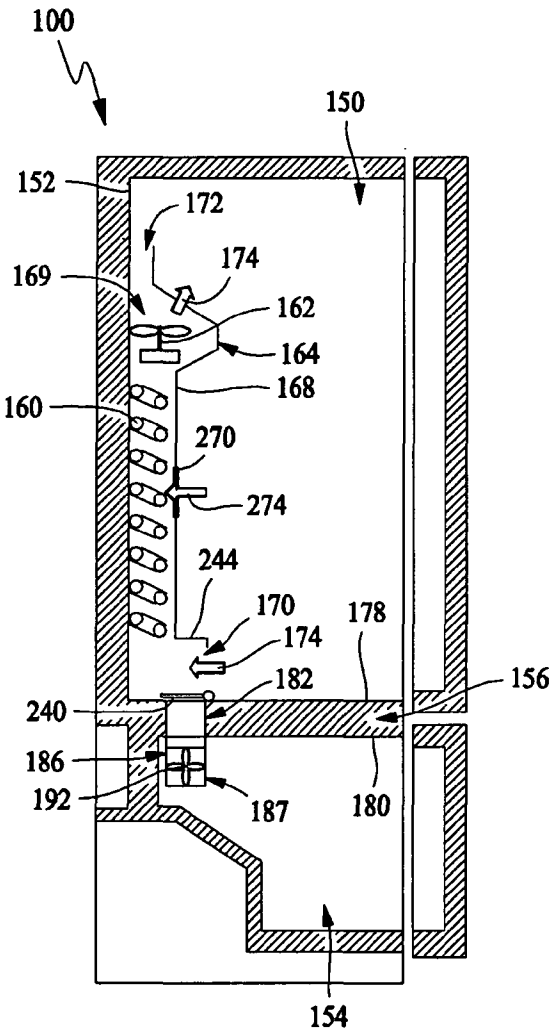
FIG. 11 is a side view of another embodiment of the refrigerator having upper and lower components.
Figure 13:
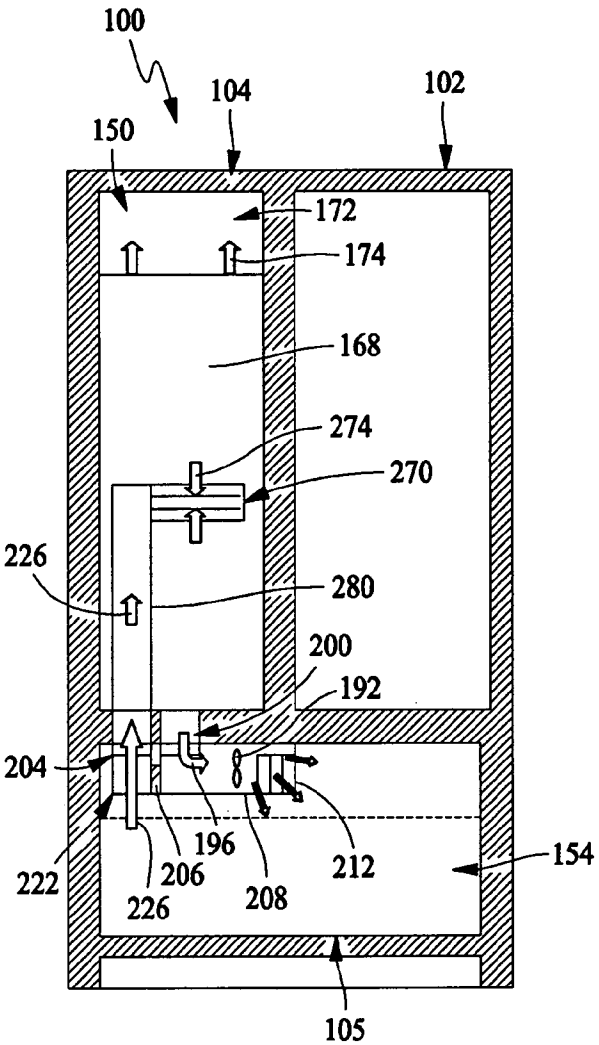
FIG. 13 is a front view of the refrigerator shown in FIGS. 11 and 12.
Figure 12:
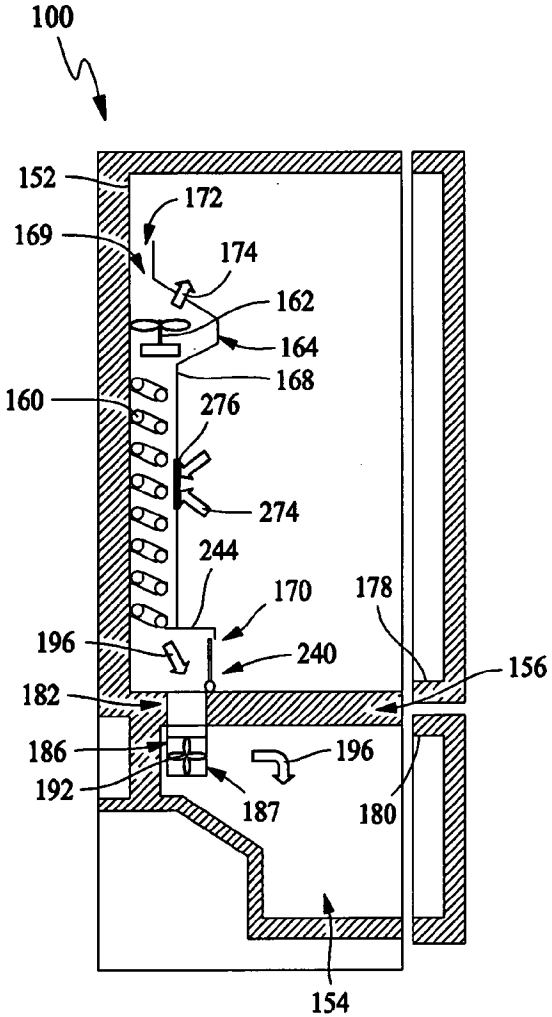
FIG. 12 is a side view of another embodiment of the refrigerator having upper and lower components.

FIGS. 11 and 12 are side views of another embodiment of refrigerator 100 with upper and lower compartments 150 and 154. Evaporator cover 168 has an evaporator cover vent 270. When gate damper 240 is in the closed position, as shown in FIG. 11, air from upper compartment 150 enters evaporator inlet 170 and air, as indicated by arrow 274, enters through evaporator cover vent 270. When gate damper 140 is open and duct fan 192 is energized, air within evaporator 160 is drawn into lower compartment 154 through duct 182, as indicated by arrow 196 in FIG. 12. When gate damper 140 is open, air (as indicated by arrows 274) does not enter through evaporator cover vent 270. FIG. 13 is a front view of refrigerator 100 shown in FIGS. 11 and 12. When gate damper 140 is in the open position, as shown in FIG. 13, air from lower compartment 154 is returned to evaporator 160 through a lower compartment return duct 280, as indicated by arrows 226.

Exemplary embodiments of refrigerator systems are described above in detail. The systems are not limited to the specific embodiments described herein, but rather, components of each assembly may be utilized independently and separately from other components described herein. Each refrigerator component can also be used in combination with other refrigerator and evaporator components.

While the invention has been described in terms of various specific embodiments, those skilled in the art will recognize that the invention can be practiced with modification within the spirit and scope of the claims.

What is claimed is:

1. A refrigerator comprising:

a refrigeration compartment;

a freezer compartment adjacent said refrigeration compartment;

a dividing wall defining a third compartment adjacent said freezer compartment and separated from said freezer compartment by said dividing wall, said third compartment controllable in both a refrigeration mode and a freezer mode; and a duct extending through said dividing wall from a top surface of said dividing wall to a bottom surface of said dividing wall and delivering air from said freezer compartment to said third compartment, and wherein said duct is open to said freezer compartment at one of said top and bottom surfaces.

2. The refrigerator according to claim 1 wherein said duct providing flow communication between said freezer and third compartments, said duct having a damper disposed therein for opening and closing said duct, said duct having a duct fan disposed therein for selectively controlling flow communication from said freezer compartment to said third compartment.

3. The refrigerator according to claim 1 wherein said freezer compartment includes an evaporator and an evaporator fan for circulating air within said freezer compartment.

4. The refrigerator according to claim 1 wherein said third compartment includes a drawer slidably received within said third compartment, said drawer providing access to said third compartment.

5. The refrigerator according to claim 2 further comprising a secondary duct providing flow communication from said third compartment to said freezer compartment when said damper is open and said duct fan is on.

6. The refrigerator according to claim 2 wherein said duct has an assembly portion extending into said third compartment.

7. The refrigerator according to claim 6 wherein said duct fan and said damper are disposed in said assembly portion of said duct.

8. A refrigerator comprising:

an upper compartment including an evaporator and a fan therein, said evaporator and said fan enclosed by an evaporator cover having an inlet and an outlet;

a dividing wall defining a lower compartment separated from said upper compartment by said dividing wall;

a duct extending through said dividing wall from a top surface of said dividing wall to a bottom surface of said dividing wall and delivering air from said upper compartment to said lower compartment, and wherein said duct is open to said upper compartment at said top surface, said duct having a damper disposed therein for opening and closing said duct, said duct having a duct fan disposed therein; and a supply conduit having a first end and a second end, said first end coupled to said evaporator cover, and said second end coupled to said duct such that said supply conduit provides flow communication from said evaporator to said duct.

9. The refrigerator according to claim 8 wherein said evaporator fan circulates air into said inlet, through said evaporator, and out said outlet when said damper is closed.

10. The refrigerator according to claim 8 wherein said first end of said supply conduit is coupled to said evaporator cover between said inlet and said outlet of said evaporator cover.

11. The refrigerator according to claim 8 further comprising a secondary duct providing flow communication from said lower compartment to said upper compartment when said damper is open and said duct fan is on.

12. The refrigerator according to claim 8 wherein said duct has an assembly portion extending into said lower compartment, said damper and said duct fan are disposed in said assembly portion.

13. The refrigerator according to claim 8 wherein said lower compartment includes a drawer slidably received within said lower compartment, said drawer providing access to said lower compartment.

14. The refrigerator according to claim 8 wherein said supply conduit provides partially evaporated air from said evaporator to said lower compartment through said duct when said damper is open and said duct fan is energized.

15. A refrigerator compartment comprising:

an upper compartment including an evaporator and a fan therein, said evaporator and fan enclosed by an evaporator cover having an inlet and an outlet;

a dividing wall defining a lower compartment separated from said upper compartment by said dividing wall, said dividing wall having a top surface and a bottom surface;

a first duct extending through said dividing wall providing an opening from said top surface to said bottom surface, said first duct is proximate to said evaporator;

a second duct extending through said dividing wall providing an opening from said top surface to said bottom surface and delivering air from said upper compartment to said lower compartment, said second duct being open to said upper compartment at said top surface; and a gate damper coupled to said top surface of said dividing wall, said gate damper rotatable between an open position and a closed position.

16. The refrigerator according to claim 15 wherein said first duct provides flow communication from said lower compartment to said inlet of said evaporator when said gate damper is in said open position.

17. The refrigerator according to claim 15 wherein said second duct provides flow communication from said upper compartment to said lower compartment when said gate damper is in said open position.

18. The refrigerator according to claim 15 wherein said gate damper is in said open position when said gate damper contacts the evaporator cover.

19. The refrigerator according to claim 15 wherein said gate damper is in said closed position when said gate damper substantially covers said first duct.

20. The refrigerator according to claim 15 wherein said lower compartment is substantially sealed off from upper compartment when said gate damper is in the closed position.

21. The refrigerator according to claim 15 further comprising an evaporator cover vent in said evaporator cover, said evaporator cover vent disposed between said inlet and said outlet of said evaporator cover.

22. The refrigerator according to claim 21 wherein air enters through said evaporator cover vent when said gate damper is in the closed position.

23. The refrigerator according to claim 21 wherein air does not enter through said evaporator cover vent when said gate damper is in the open position.

* * * * *